United States Patent [19]

Goldstein

[11] 4,394,803

[45] Jul. 26, 1983

[54] ELASTICIZED OVERLAY

[75] Inventor: Samuel A. Goldstein, Newtown Square, Pa.

[73] Assignee: Polsam, Inc., Newtown Square, Pa.

[21] Appl. No.: 272,284

[22] Filed: Jun. 10, 1981

[51] Int. Cl.[3] ..... A43B 11/00; A43C 7/06

[52] U.S. Cl. ..... 36/51; 36/50; 36/71

[58] Field of Search ..... 36/51, 55, 56, 58.5, 36/71, 50, 126, 127, 128, 129, 130

[56] References Cited

U.S. PATENT DOCUMENTS

| | | | |
|---|---|---|---|
| 74,707 | 2/1868 | McNamara | 36/51 |
| 239,005 | 3/1881 | Whitney | 36/51 |
| 1,809,998 | 6/1931 | Wernmark | 36/50 |
| 1,921,177 | 8/1933 | Watanabe | 36/51 |
| 2,243,737 | 5/1941 | Marinetti | 36/50 |
| 2,292,556 | 8/1942 | Whitman | 36/71 |
| 3,484,957 | 12/1969 | Druilhet | 36/71 |

*Primary Examiner*—Werner H. Schroeder
*Assistant Examiner*—Steven N. Meyers
*Attorney, Agent, or Firm*—Karl L. Spivak

[57] ABSTRACT

The elasticized overlay is particularly adaptable for use in an athletic type shoe which includes a tongue and a modified blucher construction. The modified blucher is fabricated without eyelets and receives thereover the elasticized overlay. An elasticized fabric together with suitable attaching strips is affixed to the shoe along one edge to form the elasticized blucher overlay. The elasticized fabric extends substantially the entire length of the blucher construction and has the free edge provided with a plurality of spaced eyelets to accommodate an eyelet lacing system. The blucher and tongue can be padded with a foam lining to shield the wearer's foot from pressures developed in the elasticized fabric and imposed at the laces.

12 Claims, 4 Drawing Figures

ELASTICIZED OVERLAY

BACKGROUND OF THE INVENTION

The present invention relates generally to the field of shoe constructions, and more particularly, is directed to an athletic type shoe including an elasticized blucher overlay.

It is usual practice to design and fabricate many types of shoes including athletic shoes such as sneakers, jogging shoes, tennis shoes, etc. with leather or rubber soles and leather or leather simulated plastic uppers of conventional configuration. Many prior art athletic and other shoe designs utilize a blucher construction having an associated tongue and an eyelet lacing system.

The presently available athletic shoes usually include a resilient sole of various configurations for impact relief purposes and many such shoes have additionally been padded in efforts to provide increased protection for the feet of the wearer. However, so far as is known to the applicant, all prior art athletic type shoes incorporate materials of construction having relatively little resiliency or "give" about the wearer's foot. Accordingly, all squeezing pressures resulting from lacing the shoe are constantly applied without regard to the activity, the bending or the position of the foot. When it is desired to increase or decrease the tightness of the shoe about the foot, it is now necessary to manually adjust the tension of the laces. There is presently no known method for providing automatic tensioning adjustment or automatic support variation of the shoe relative to the wearer's foot.

SUMMARY OF THE INVENTION

The present invention relates generally to an elasticized shoe construction, and more particularly, is directed to an elasticized blucher overlay which is adapted to continuously apply resilient support forces about the foot of the wearer.

The present invention includes a shoe, preferably of the athletic shoe type, having a tongue and usual blucher construction modified as necessary to eliminate all lace openings or eyelets in the blucher. An elasticized fabric overfits the blucher and is securely affixed along one longitudinal edge thereto. The other longitudinal edge is provided with a plurality of lacing eyelets and is not connected to the shoe upper to thus provide easier lacing.

Preferably a decorative leather or leather simulated plastic attaching strip covers the edges of the elastic fabric and acts as an anchoring device to affix the connected portion of the elasticized fabric to the blucher. The elasticized fabric terminates inwardly in a free edge in registry over the free edge of the blucher and is provided with a decorative reinforcing strip and a plurality of eyelets to receive conventional laces therein for shoe lacing purposes.

It is noteworthy that the lacing edge of the fabric is maintained free and is pivotal over the blucher to provide an easier lacing construction. Accordingly, by lacing the shoe between the adjacent pluralities of eyelets provided in the inwardly free edges of the left and right overlays, the elasticized fabric can be stretched to thereby apply a girdling effect to act as a support about the medial portion of the wearer's foot. The elasticized foot girdle formed by the pair of elasticized overlays together with the laces which are utilized cooperate to continuously provide support for the wearer's feet at all times, and for example, when running, when walking or when engaged in any active sports. Preferably, the blucher and the tongue are padded in known manner, such as by employing foam linings, to shield the wearer's foot from the pressures of the lace lines.

It is therefore an object of the present invention to provide an improved elasticized overlay type of shoe construction of the type set forth.

It is another object of the present invention to provide a novel, elasticized shoe construction comprising an elasticized blucher overlay and an eyelet lacing system formed in a free edge of the overlay.

It is another object of the present invention to provide an elasticized athletic shoe comprising a tongue, a modified blucher construction and an elasticized overlay including an eyelet lacing system in the overlay and not the blucher.

It is another object of the present invention to provide a novel elasticized shoe construction including a blucher overlay and means to provide an elasticized girdling effect upon the foot of the wearer.

It is another object of the present invention to provide a novel elasticized overlay that is simple in design, inexpensive in fabrication and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figures 1, 2:
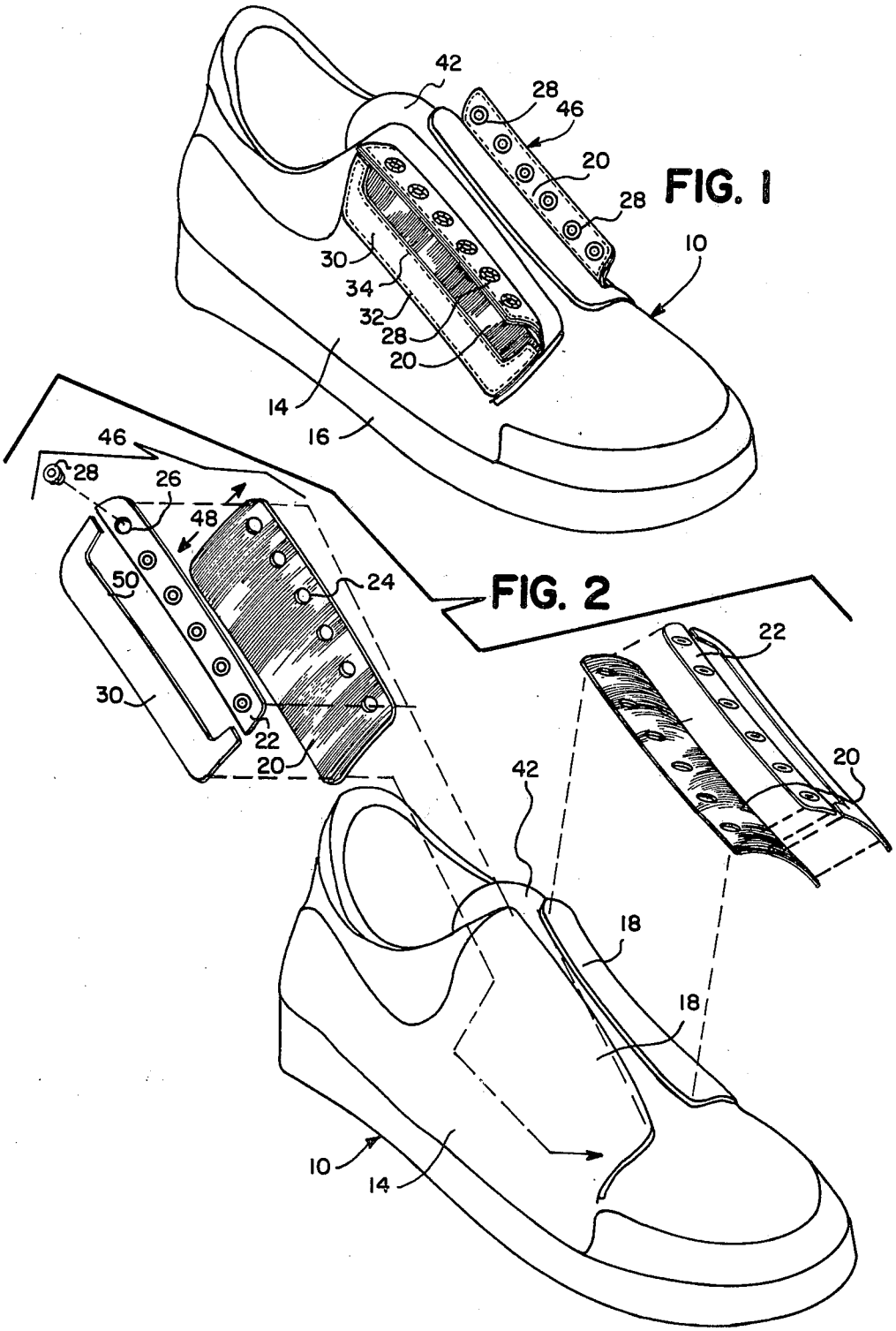
FIG. 1 is a perspective view of an athletic shoe illustrating the present invention.
FIG. 2 is an exploded perspective view of the shoe of FIG. 1.

Although specific terms are used in the following description for the sake of clarity, these terms are intended to refer only to the particular structure of the invention selected for illustration in the drawings, and are not intended to define or limit the scope of the invention.

Figure 3:
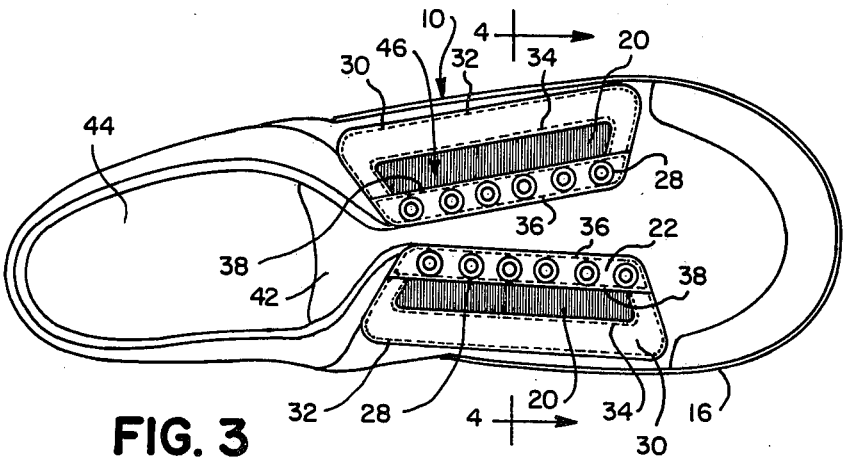
FIG. 3 is a top plan view of the shoe of FIG. 1.

Referring now to the drawings, there is shown in FIGS. 1 and 3 a shoe 10 which is preferably of the athletic shoe type, such as a jogging shoe, a tennis shoe, a sneaker or the like. The shoe 10 includes a rubber or other nonskid type material sole 12 which is affixed in known manner the usual shoe upper construction 14. An inner sole 44 may interiorly be affixed in position to cover the sole 12 in known manner, to increase the comfort of the wearer and to present a finished appearance. A decorative rubber or other material band 16 covers the periphery of the sole and the bottom periphery of the shoe upper 14 in known manner to provide a decorative strengthening band thereabout.

The shoe upper 14 terminates upwardly in a modified blucher construction 18 which includes a tongue 42 in usual manner. As best seen in FIG. 2, the blucher construction 18 is modified in a manner to completely eliminate all lace openings, grommets, eyelets, or the like. The blucher is maintained entirely plain and unpierced and is accordingly not utilized for lacing as in previously employed blucher type shoe constructions. As illustrated, the modified blucher 18 is provided and equipped with an elasticized blucher overlay assembly means 46, which assembly can be stitched or otherwise permanently attached to the blucher construction by utilizing known shoe fabrication techniques.

As best seen in FIGS. 1 and 2, each elasticized blucher overlay assembly 46 comprises a sheet of elasticized fabric 20 of generally rectangular configuration. The elasticized fabric preferably in resilient or yieldable in the transverse direction as indicated by the double headed arrow 48 and preferably provides no elongation in the longitudinal direction, that is at right angles to the direction indicated by the arrow 48. The longitudinal inward or tongue edge of the elasticized fabric 20 is provided with a plurality of longitudinally spaced openings 24 for lacing purposes in the usual manner. An eyelet or reinforcing strip 22, which may be fabricated of leather, fabric, plastic or other known material, is also provided with a plurality of openings 26. The strip openings 26 register over the fabric openings 24 when the eyelet strip 22 is affixed over the longitudinal inward edge of the elasticized fabric 20. As best seen in FIG. 3, the eyelet strip 22 can be conventionally applied over and affixed to the edge of the elasticized fabric 20 by employing stitching 36, 38 in well known manner.

The outer or lower longitudinal edge of the elasticized fabric 20 of each blucher overlay 46 is preferably affixed to the shoe 10 over the blucher 18 by utilizing a generally U-shaped decorative attaching strip 30, which strip may conventionally be fabricated of leather, fabric, plastic or other plyable material. An outer, generally U-shaped attaching stitched seam 32 is sewn through the outer periphery of the attaching strip 30, through the lower peripheral edge of the elasticized fabric 20 and directly through the lower portion of the blucher 18 to position each elasticized blucher overlay assembly 46 directly over the blucher 18. Preferably the interior periphery 50 of the attaching strip 30 is also affixed to the fabric 20 and is sewn through the elasticized fabric 20 and through the blucher for additional strengthening purposes. The fabric stitched seam 34 is employed for this purpose in known manner, as best seen in FIGS. 1 and 3.

A plurality of metallic or other suitable material grommets or eyelets 28 insert through the registered openings 24, 26 in the elasticized fabric 20 and in the eyelet strip 22 and the eyelets 28 are secured therein in known manner, for example by crimping, for receipt therethrough of a lace (not shown) for securing the shoe 10 in the usual manner. The eyelet strip 22 conventionally can be secured to the inward or upward longitudinal edge of the elasticized fabric 20 by utilizing a pair of transversely spaced, generally longitudinally aligned, stitched seams 36, 38. Alternately, it would also be possible to secure the eyelet strip 22 to the elasticized fabric 20 by employing suitable, known adhesives in manner well known to those skilled in the art.

Figure 4:
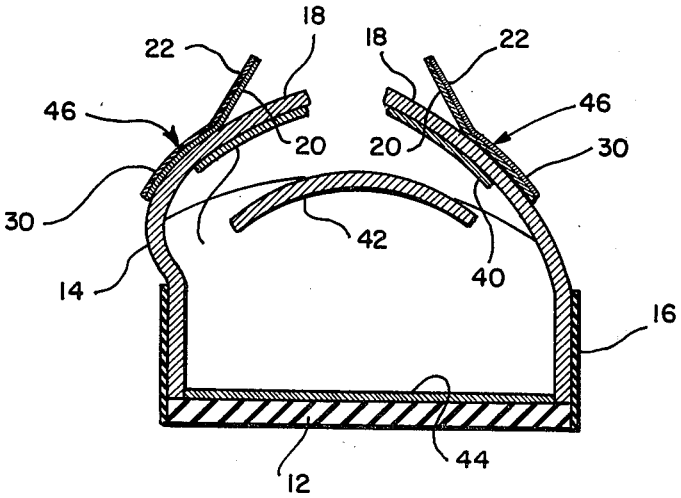
FIG. 4 is a cross sectional view taken along line 4—4 on FIG. 3, looking in the direction of the arrows.

As best seen in FIGS. 1 and 4, each elasticized blucher overlay assembly 26 is affixed to the upper 14 of the shoe 10 by the stitching 32, 34 which extends about the inner and outer peripheries of the U-shaped attaching strip 30. The longitudinal eyelet portion 52 of the overlay assembly 46 is not affixed to the blucher 18 and this portion forms a flap whereby the elasticized fabric 20 can be bent or folded about the eyelet strip 22 relative to the blucher 18 to facilitate lacing when the shoe is to be worn.

In order to use the athletic shoe 10 of the present invention, the wearer (not shown) first places his foot in the shoe in the usual manner and then threads the lace (not shown) alternately through the left and right eyelets or grommets 28 to lace the shoe in well known manner. The laces are pulled sufficiently tight through the plurality of eyelets 28 to tension each elasticized blucher overlay assembly 46. The stretching of the elasticized fabrics in the directions of the arrow 48 creates a girdling effect about the foot to provide transverse, overall support about the medial portion of the foot of the wearer. It will be appreciated that as the wearer runs, jumps or otherwise exercises, the elasticized fabric 20 will expand or contract in the directions indicated by the arrow 48 as necessary to tightly conform to the various configurations of the foot to thereby apply continuous support about the foot of the user under all conditions of use. In view of the fact that the laces (not shown) are always under tension due to the stretching of the elasticized fabric 20, it may be more comfortable for the wearer to provide a foam plastic or other padding 40 below the blucher 18 and tongue 42 to shield the foot from pressures applied by portions of the laces across the top of the shoe. See FIG. 4.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. In a shoe having an upper of the blucher construction type adapted to be secured to the foot of the wearer by a shoe lace, the combination of a modified blucher construction, said modified blucher construction having no lacing openings therethrough, the blucher construction defining a longitudinal blucher opening therebetween;

a blucher overlay assembly means affixed to the blucher construction and defining an overlay opening in registry above the blucher opening, said blucher overlay assembly means comprising an elasticized fabric and a plurality of eyelets therein for receiving portions of the lace therethrough, the fabric having a connected longitudinal edge and a free longitudinal edge, the connected edge being secured to the modified blucher construction and the eyelets being secured in the said free edge, whereby the fabric can be tensioned by the shoe lace.

2. The shoe construction of claim 1 wherein the elasticized fabric has elasticity in a direction toward and away from the said eyelets.

3. The shoe construction of claim 2 wherein the elasticized fabric has no elasticity in a direction substantially at right angles to a direction toward or away from the eyelets.

4. The shoe construction of claim 1 wherein the blucher overlay assembly means is not affixed to the modified blucher along the said free longitudinal edge of the elasticized fabric.

5. In a shoe having an upper of the blucher construction type adapted to be secured to the foot of the wearer by a shoe lace, the combination of a modified blucher construction, said modified blucher construction having no lacing openings therethrough; and a blucher overlay assembly means affixed to the blucher construction, said blucher overlay assembly means comprising an elasticized fabric and a plurality of eyelets therethrough for receiving portions of the lace therein, the elasticized fabric being generally rectangular in configuration and comprising a top longitudinal edge, a bottom longitudinal edge, a left transverse edge and a right transverse edge, the blucher overlay assembly means being affixed to the modified blucher along the said bottom longitudinal edge, the blucher overlay means being additionally affixed to the modified blucher along portions of the said left transverse elasticized fabric edge.

6. The shoe construction of claim 5 wherein the blucher overlay assembly means is affixed to the modified blucher along portions of the right transverse elasticized fabric edge.

7. The shoe construction of claim 5 wherein the affixed portion of the left transverse edge adjoins the affixed fabric bottom longitudinal edge.

8. The shoe construction of claim 5 wherein the affixed portion of the right transverse edge adjoins the affixed fabric bottom longitudinal edge.

9. The shoe construction of claim 5 wherein the top longitudinal edge of the said blucher overlay assembly means is adapted to be pivotal relative to the modified blucher construction to facilitate lacing.

10. The shoe construction of claim 9 wherein the top longitudinal edge is adapted for transverse movement relative to the longitudinal axis of the shoe in response to pulling forces generated by the tightness of the shoe lacing.

11. The shoe construction of claim 1 and padding affixed to the modified blucher construction the padding being interposed between the shoe lace and the foot of the wearer.

12. The shoe construction of claim 11 and a tongue interposed between the padding and the foot of the wearer.

* * * * *